United States Patent [19]

Hsiao

[11] Patent Number: 4,970,881

[45] Date of Patent: Nov. 20, 1990

[54] CODE VARIABLE COMBINATION LOCK

[76] Inventor: Li-Chuan Hsiao, No. 26-6, Chung Shih Lane, Hsi Shih Li, Changhua City, Taiwan

[21] Appl. No.: 305,978

[22] Filed: Feb. 3, 1989

[51] Int. Cl.[5] ..... E05B 37/06

[52] U.S. Cl. ..... 70/25; 70/312

[58] Field of Search ..... 70/21, 22, 25, 312, 70/315

[56] References Cited

U.S. PATENT DOCUMENTS

| | | | |
|---|---|---|---|
| 2,160,698 | 5/1939 | Herbst | 70/25 |
| 3,410,121 | 11/1968 | Morin | 70/25 |
| 3,720,082 | 3/1973 | Feinberg et al. | 70/25 |
| 3,837,189 | 9/1974 | Atkinson | 70/21 |
| 4,308,731 | 1/1982 | Remington | 70/312 X |
| 4,327,566 | 5/1982 | Ling | 70/312 |
| 4,444,029 | 4/1984 | Remington | 70/25 |
| 4,445,348 | 5/1984 | Saitoh | 70/312 |
| 4,733,548 | 3/1988 | Ling | 70/25 |
| 4,742,700 | 5/1988 | Ling | 70/25 |
| 4,766,748 | 8/1988 | Yang | 70/312 |
| 4,829,794 | 5/1989 | Crown | 70/25 |

*Primary Examiner*—Robert L. Wolfe

*Assistant Examiner*—Suzanne L. Dino

*Attorney, Agent, or Firm*—Browdy and Neimark

[57] ABSTRACT

The present disclosure is related to a code variable combination lock which is equipped with a code setting and locking assembly made up of a number of dial wheels having consecutive digits disposed thereon and a number of corresponding wheel sleeves which all are mounted on a lock core with a biasing spring and a stop member disposed at the end thereof. A push bracket having a latch hook disposed at the front end thereof is slidably engaged with the rightmost wheel sleeve. On the inner and outer surfaces of each wheel sleeve are disposed protrusions, and the inner wall of each dial wheel is provided with a plurality of spaced grooves. By actuation of the latch hook forward or backward with the protrusions on the wheel sleeves in selective conformance or non-conformance to the grooves on the dial wheels and on the lock core and to a flat plane defined at the front end of the lock core, the dial wheels can be rotated freely for setting new code or locked without moving for protection of the code, the present combination lock can be unlocked once the lock core is permitted to move forward over the wheel sleeves and dial wheels.

1 Claim, 2 Drawing Sheets

CODE VARIABLE COMBINATION LOCK

BACKGROUND OF THE INVENTION

The present invention particularly relates to a combination lock adapted for locking a tourist's luggage, or also applicable to the locking of windows, cases, or articles of the like, which is characterized by its features of code being re-settable in accordance with the user's requirement, and the set code being not able to be spoiled accidentally.

As shown in FIG. 1, one type of conventional lock is shown which is only operated by a key, and becomes non-functional once the key, is accidentally lost. Moreover, carrying a bunch of keys around is rather inconvenient and impractical.

Therefore, another type of keyless lock has been developed, so called combination lock, as shown in FIG. 2. Generally, the prior art combination lock is assigned with a fixed code during its assembly in factory. The lock becomes insecure when the code is accidently exposed to other people.

The present inventor noticed the problem and has worked out an improved code-variable combination lock which is readily operated and has a conveniently variable code so that a person can make the best use of the combination lock according to different situational requirements.

SUMMARY OF THE INVENTION

Therefore, the primary object of the present invention is to provide a code variable combination lock which can be operated with a plurality of selective codes set by the user of the lock readily as desired.

One further object of the present invention is to provide a code vaiable combination lock, the latch hook of which is automatically engaged with the lock hole after a new code is set and the set code will not be spoiled accidentally.

BRIEF DESCRIPTION OF THE DRAWINGS

To better illustrate the structure, operation modes and features of the present invention, a number of drawings are given in company with a detailed description of the preferred embodiment of the present invention, in which.

DETAILED DESCRIPTION OF PREFERRED EMBODIMENT

Figure 1:
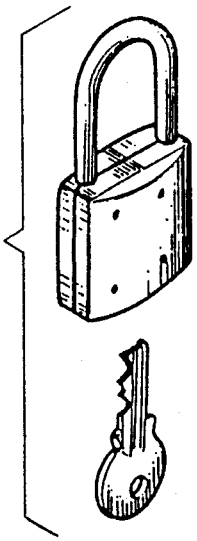
FIG. 1 (PRIOR ART)
FIG. 1 is a diagram showing a prior art lock with a key.
Figure 2:
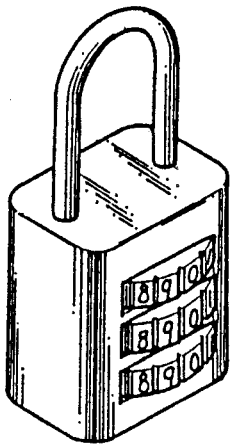
FIG. 2 (PRIOR ART)
FIG. 2. is a prior art combination lock.
Figure 3:
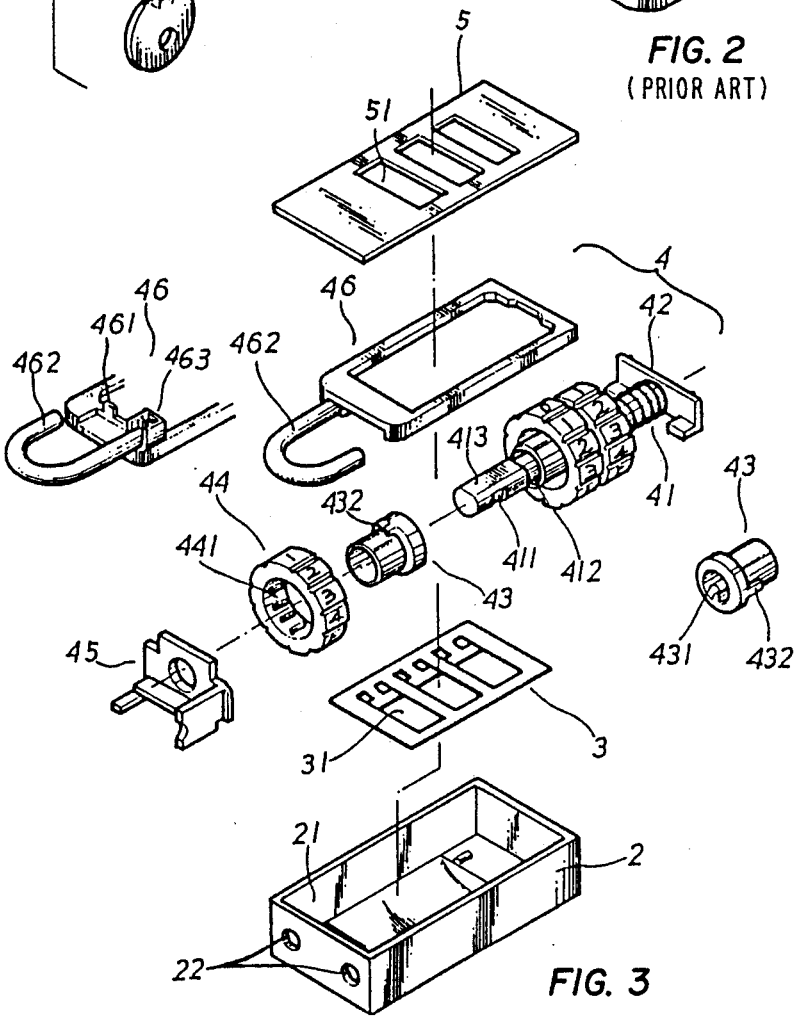
FIG. 3 is a perspective view showing the exploded components of the present invention.
Figure 4:
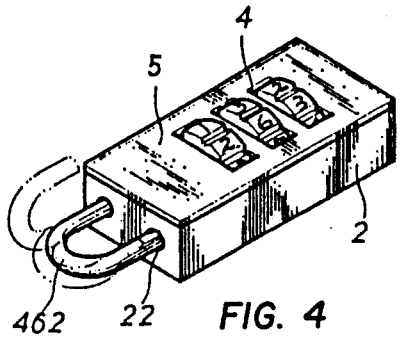
FIG. 4 is a perspective view showing the present combination lock.
Figure 6A:
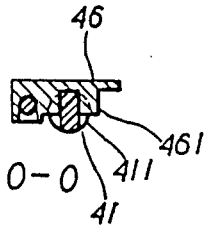
FIG. 6A is a diagram showing the sectional view of FIG. 5 taken along the line 0—0.

As shown in FIGS. 3, 4, a code variable combination lock of the present invention mainly comprises an open topped casing 2 having a receiving space 21. On the front wall of the casing 2 a pair of through holes 22 is disposed and a confining plate 3 fixedly mounted in the casing 2 is provided with a number of parallel slot-like opening 31. A code setting and locking assembly 4 housed in the casing 2 has a lock core 41 which is provided with a pair of engagement recesses 411 on the surface of its end portion, and a number of spaced grooves 412 is correspondence to the slot-like opening 31 are defined at the middle portion thereof, the end of the lock core 41 on the opposite surface of the engagement recesses 411 being defined as a flat plane 413. A spring 42 is; disposed on the lock core 41. A number of wheel fixing sleeves 43 corresponding to the slot-like openings 31 are mounted on the lock core 41 with a fixing protrusion spot 431 on the inner wall thereof which is engaged with the engagement grooves 412 of the lock core 41 in such a manner that the wheel fixing sleeves 43 can be either freely rotated with respect to the lock core 41 or locked in place without rotation with thereto. Another protrusion 432 is disposed on the outer wall of the wheel sleeve 43, and; an equal amount of dial wheels 44 are provided on the outer surface of which are disposed a plurality of digits and on the inner surface of which are placed a plurality of spaced axially oriented grooves 441 which are able to be in operational engagement or disengagement with the protrusion 432 of the wheel fixing sleeve 43. An abutment member 45 is attached at the end of the lock core 41 and is adapted for the fixing of the lock core 41 and also for the urging of the wheel fixing sleeves 43 toward the spring 42. A push bracket 4l is disposed within the casing 2 and is able to smoothly move therin, a pair of engagement lugs 461 being disposed at the bottom surface of the front edge of the push bracket 46 and being able to be in engagement with the engagement recesses 411 disposed at the end of the lock core 41. A hood 462 is pivotally and self rotatable mounted on the push bracket 4l.

The latch hook 462 is pivotally mounted to the push bracket 46 by way of a groove defined on the long leg thereof which is located in a fixing means 463. Alternatively, an equivalent means can be applied to the fixing of the hook to the push bracket 46. The legs of the hook are guided through the holes 22 respectively in assembly.

A lid 5 is adapted for the sealing coverage of the casing 2 with a number of corresponding slots 51 disposed thereon, permitting the location of the dial wheels 44 with a portion thereof exposed externally for the dialing operation by a person.

By dialing the dial wheels 44, the push bracket 46 along with the hook 462 can be either permitted to move or not to move so that the present lock can be locked or unlocked accordingly.

Figure 5:
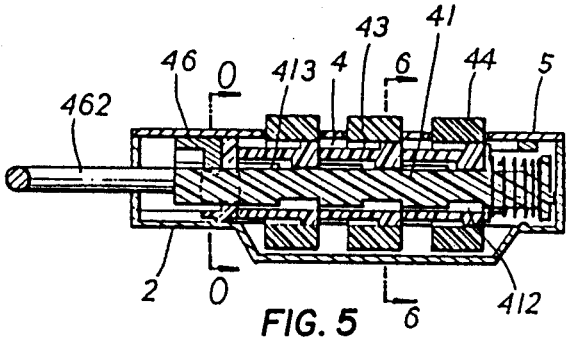
FIG. 5 is a sectional view showing the inner arrangement of the present combination lock.
Figure 6:
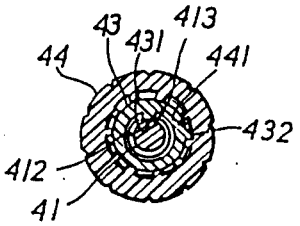
FIG. 6. is a diagram showing the sectional view of FIG. 5 taken along the line 6—6.
Figure 7:
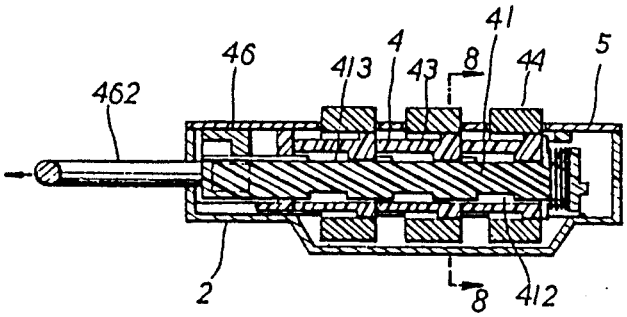
FIG. 7 is a sectional view showing the forward movement of the lock core of the present lock as a result of the pull of the latch hook with the spring disposed at the end of the lock core being compressed.

The operations of the present combination lock, including the locking and unlocking and code setting of the lock, depend on the code setting and locking assembly 4. As shown in FIGS. 5, 6, the present lock can be operated only with the code set right in such a manner that the push bracket 46 can be actuated along with the hook 462. In other words, when the fixing protrusion spot 431 of the wheel fixing sleeve 43 is turned to be in operational conformance to the flat plane 413 of the lock core 41, the short leg of the hook 462 can be disengaged from the holes 22 of the casing 2 so that the lock can be unlocked as shown in FIG. 7.

Figure 8:
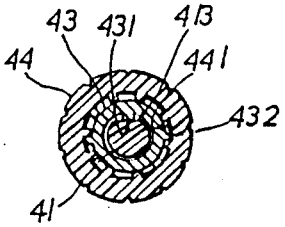
FIG. 8 is a sectional view taken along the line 8—8 of FIG. 7.

As the lock is unlocked, the lock core 41 is moved toward the holes 22, making the fixing protrusion spot 431 of the wheel sleeve 43 engage with the flat plane 413 as shown in FIG. 8. Thus, the wheel sleeves 43 will not be able to rotate on the lock core 41, and the dial wheel 44 will accordingly not be moved on the lock core 41 either.

With the wheel sleeves 43 and the dial wheels 44 not being able to move, the set code will not be accidentally put in error so to permit the hook 462 engage with the corresponding hole 22.

As the hook 462 is put in an unlocked position, the spring 42 is compressed as a result of the urge by the lock core 41. The compressed spring acquires potential energy, so that, accordingly, once the external force against the lock core 41 is removed with the hook 462 placed right in conformance with the hole 22, the short leg of the hook 462 will be engaged with the hole 22 automatically. Thus the locking operation of the present invention can be performed in a more facilitating manner.

Figure 9:
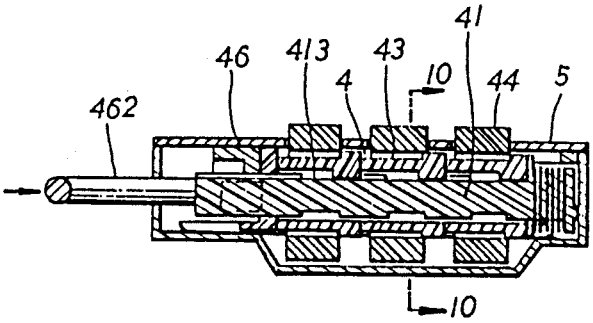
FIG. 9 is a diagram showing the backward movement of the lock core with the latch hook released.
Figure 10:
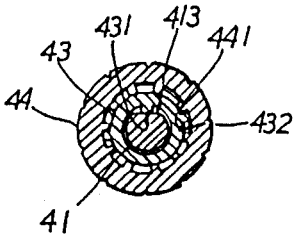
FIG. 10 is a sectional view of FIG. 9 taken along the line 10—10.

During unlocking operaion or in a locked status, the dial wheels 44 and wheel sleeves 43 are engaged with each other, therefore the dial wheels 44 are not able to be rotated alone. Accordingly, if a new set of code is to be applied, the person to set the code must pull the hook 462 outward to make push bracket 46 move forward for urging the abutment member 45 so as to drive the wheel sleeves 43 to move toward the spring 42 with the same compressed, so that the protrusions 432 of the wheel sleeves 43 can disengage from the grooves 441 of the dial wheel 44, as shown in FIGS. 9, 10, permitting the dial wheels to rotate freely for code re-setting operation. The above described operation must be performed only with the fixing protrusions spot 431 are right in conformance with the flat plane 413 of the lock core 41, as shown in FIGS. 6, 8. After the setting of new code, the release of the spring 42 will allow the wheel sleeves 43 to be pushed back to their original positions and the wheel sleeves 43 and the dial wheels 44 are able to engage with each other once more.

What I claim is:

1. An improved combination lock comprising:

an open topped casing having a pair of holes disposed at the front wall thereof;

a confining plate having a number of parallel slot-like openings disposed thereon;

a code setting and locking assembly;

a lid having corresponding slot-like openings to those of said confining plate;

wherein said code setting locking assembly comprises a lock core on which are mounted a number of wheel sleeves with each of said wheel sleeves being attached with dial wheels having consecutive digits disposed thereon; the dial wheels are disposed through said slot-like openings of said confining plate and said lid with a portion thereof exposed externally for dialing; at the front end of said lock core is disposed an abutment member; and a push bracket having an opening, permitting said dial wheel and said wheel sleeves to go through said push bracket in assembly; the lock core is provided with a flat plane at the front portion thereof with a pair of engagement recesses disposed on the opposite side thereof; a number of grooves are disposed on said lock core each of which is engaged with a protrusion disposed on the inner surface of each of said wheel sleeves; and a spring is disposed at the end of said lock core with a stop member fixed at the end thereof; on the front of said push bracket is pivotally mounted a latch hook the short leg of which is able to engage with one of said holes disposed at the front end of said push bracket; on the opposite side of said push bracket, at the front end thereof, is disposed a pair of engage lugs which are able to engage the said recesses of said lock cores so to enable the lock core to be operably moved along with said push bracket; the forwardly moved lock core can be automatically brought back to its original position by said biasing spring.

* * * * *